US005536921A

United States Patent [19]

Hedrick et al.

[11] Patent Number: 5,536,921

[45] Date of Patent: Jul. 16, 1996

[54] SYSTEM FOR APPLYING MICROWARE ENERGY IN PROCESSING SHEET LIKE MATERIALS

[75] Inventors: Jeffrey C. Hedrick, Peekskill; David A. Lewis, Carmel, both of N.Y.; Jane M. Shaw, Ridgefield, Conn.; Alfred Viehbeck, Fishkill; Stanley J. Whitehair, Peekskill, both of N.Y.

[73] Assignee: International Business Machines Corporation, Armonk, N.Y.

[21] Appl. No.: 548,262

[22] Filed: Oct. 25, 1995

Related U.S. Application Data

[63] Continuation of Ser. No. 196,935, Feb. 15, 1994, abandoned.

[51] Int. Cl.[6] ..... H05B 6/80

[52] U.S. Cl. ..... 219/693; 219/692; 219/697; 219/750; 34/259

[58] Field of Search ..... 219/693, 692, 219/700, 695, 696, 697, 748, 746, 750, 773, 776, 779, 780, 710; 34/259

[56] References Cited

U.S. PATENT DOCUMENTS

| | | | |
|---|---|---|---|
| 2,549,511 | 4/1951 | Nelson | 219/697 |
| 3,426,439 | 2/1969 | Ryman et al. | 34/1 |
| 3,474,208 | 10/1969 | Puschner | 219/10.55 |
| 3,553,413 | 1/1971 | Soulier | 219/693 |
| 3,560,694 | 2/1971 | White | 219/693 |
| 3,688,068 | 8/1972 | Johnson | 219/10.55 |
| 3,705,283 | 12/1972 | Sayer, Jr. | 219/696 |
| 3,761,665 | 9/1973 | Nagao et al. | 219/696 |
| 3,775,860 | 12/1973 | Barnes et al. | 219/693 |
| 3,851,132 | 11/1974 | Van Koughnett | 219/750 |
| 4,011,197 | 3/1977 | Lee | 260/46.5 |
| 4,035,599 | 7/1977 | Kashyap et al. | 219/10.55 |
| 4,083,901 | 4/1978 | Schonfeld et al. | 264/25 |
| 4,186,044 | 1/1980 | Bradley et al. | 156/273 |
| 4,234,775 | 11/1980 | Wolfberg et al. | 219/693 |
| 4,402,778 | 9/1983 | Goldsworthy | 156/172 |
| 4,420,359 | 12/1983 | Goldsworthy | 156/379.8 |
| 4,477,707 | 10/1984 | Kim | 219/10.55 A |
| 4,495,021 | 1/1985 | Goldsworthy | 156/425 |
| 4,714,812 | 12/1987 | Haagensen et al. | 219/10.55 |
| 4,746,968 | 5/1988 | Wear et al. | 219/695 |
| 4,764,102 | 8/1988 | Takahashi | 425/466 |
| 4,803,022 | 2/1989 | Barrell et al. | 264/25 |
| 4,882,851 | 11/1989 | Wennerstrum et al. | 34/60 |
| 4,999,469 | 3/1991 | Dudley et al. | 219/10.55 A |
| 5,003,143 | 3/1991 | Marks et al. | 219/10.55 M |
| 5,064,979 | 11/1991 | Jeeger | 219/10.55 A |
| 5,107,602 | 4/1992 | Lööf | 219/697 |
| 5,146,058 | 9/1992 | Herfindahl et al. | 219/10.55 A |
| 5,162,629 | 11/1992 | Erz et al. | 219/773 |
| 5,175,406 | 12/1992 | Roussy et al. | 219/773 |
| 5,182,134 | 1/1993 | Sato | 427/543 |
| 5,191,182 | 3/1993 | Geldrme et al. | 219/10.55 B |
| 5,278,375 | 1/1994 | Berteaud et al. | 219/693 |

FOREIGN PATENT DOCUMENTS

| | | |
|---|---|---|
| 0122840 | 10/1984 | European Pat. Off. . |
| 1264758 | 10/1961 | France . |
| 2458323 | 6/1979 | France . |
| 2547732 | 12/1984 | France . |
| 1804548 | 8/1969 | Germany . |
| 1034723 | 2/1989 | Japan . |
| 0134733 | 2/1989 | Japan . |
| 2245893 | 1/1992 | United Kingdom . |
| WO91/03140 | 7/1991 | WIPO . |

OTHER PUBLICATIONS

Lewis et al, "Techniques For Microware Processing of Materials" Processing of Advanced Materials, (1991), 1, 151–159.

*Primary Examiner*—Philip H. Leung
*Attorney, Agent, or Firm*—Daniel P. Morris; Alvin J. Riddles

[57] ABSTRACT

A microwave processing system is provided wherein the material to be processed is in the form of a web type quantity configuration with a thickness that is small in relation to the wavelength of a particular microwave frequency. The material is passed through the field associated with a plurality of microwave standing waves of the particular frequency, each adjacent standing wave being offset ¼ wavelength along the direction of movement of the web. A carrier gas removes volatile solvents from the material surfaces. Control is provided for the interrelationship of temperature, rate of movement, flow of carrier gas, and microwave power.

19 Claims, 4 Drawing Sheets

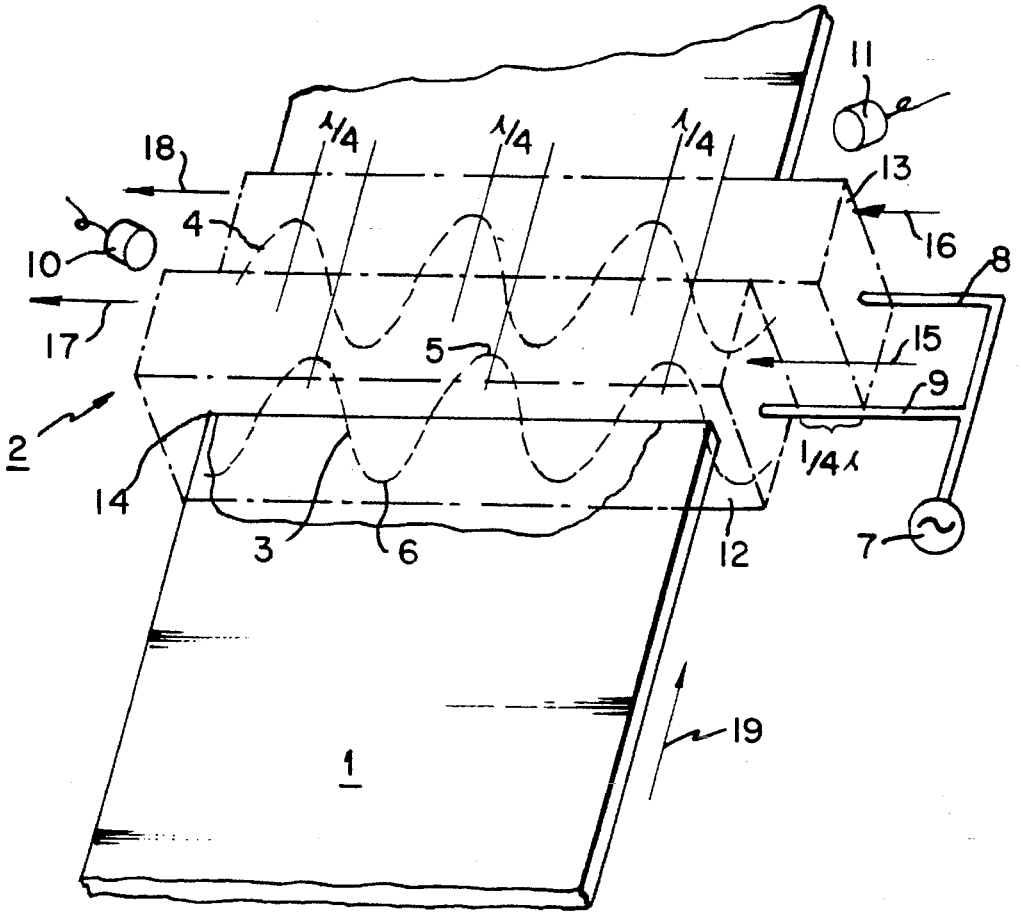
FIG. 1
FIG. 2
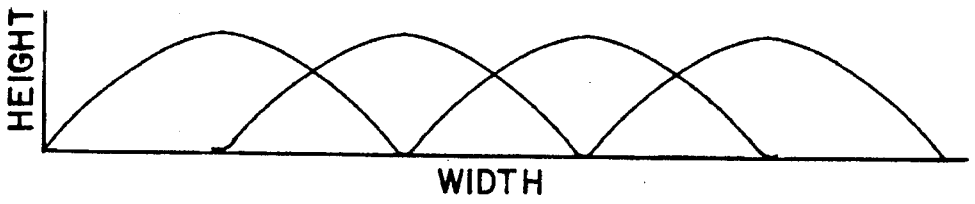

FIG.3
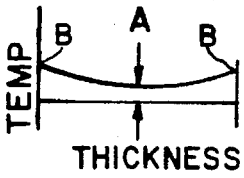
FIG.4
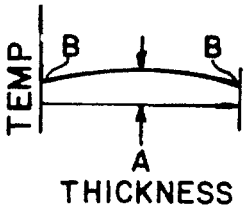
FIG.5
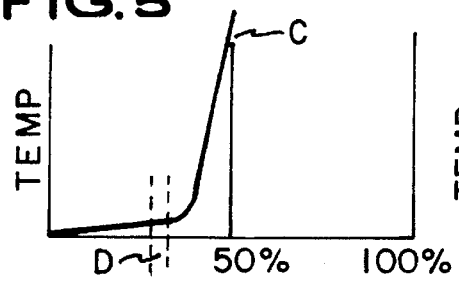
FIG.6
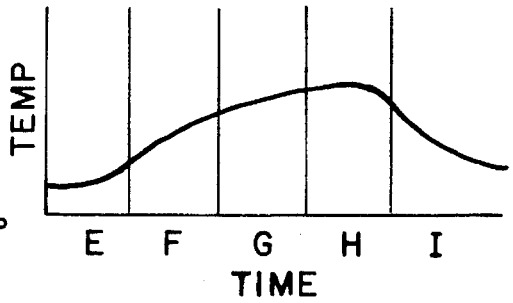
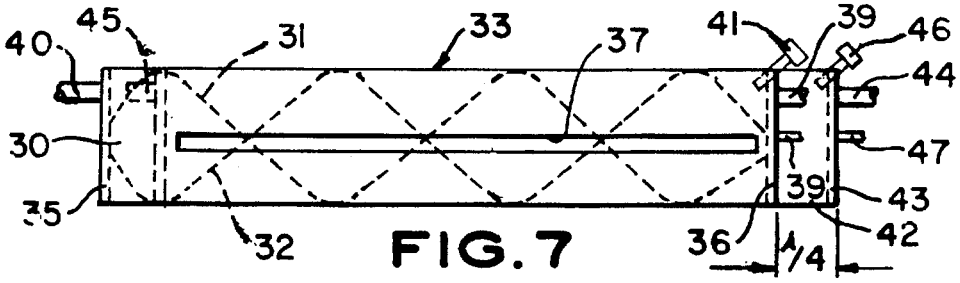
FIG.7
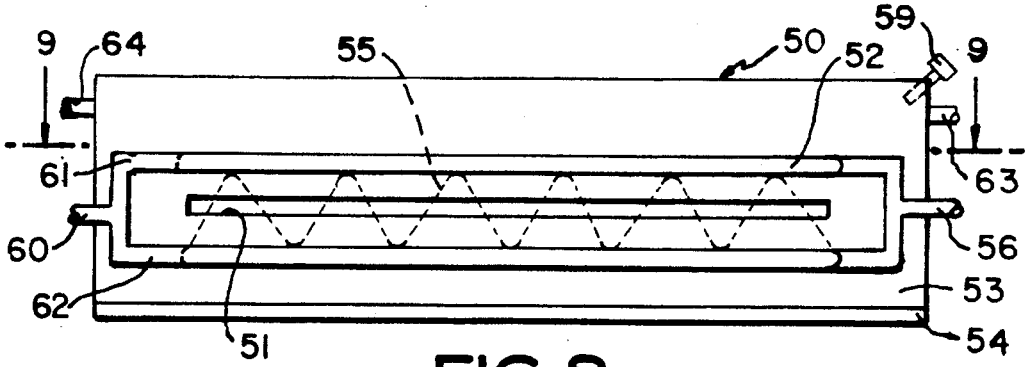
FIG.8
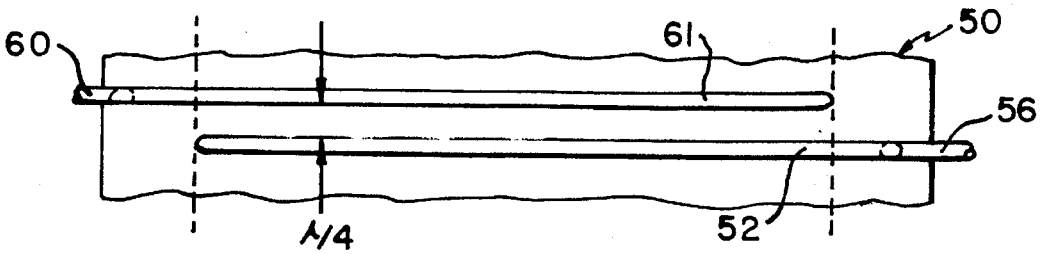
FIG.9

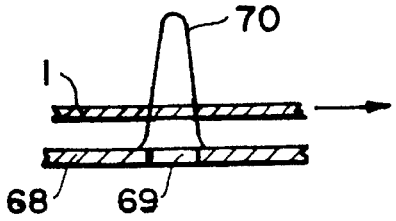
FIG.11
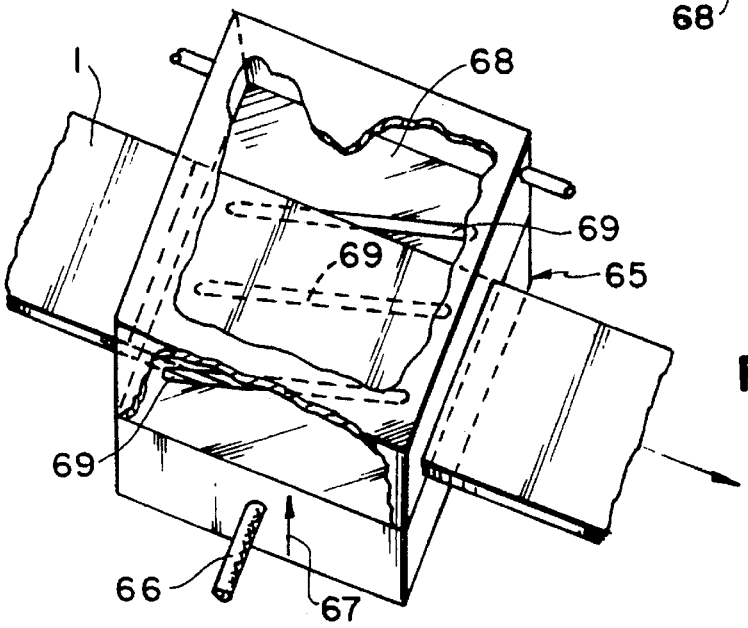
FIG.10
FIG.12
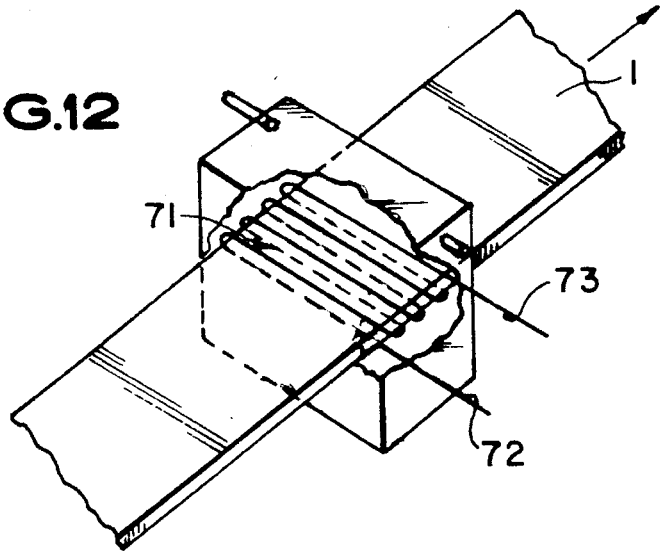
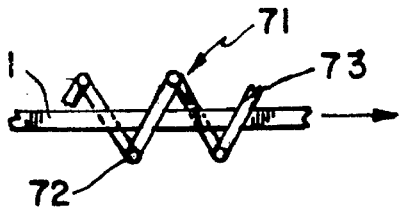
FIG.13

SYSTEM FOR APPLYING MICROWARE ENERGY IN PROCESSING SHEET LIKE MATERIALS

This application is a continuation of application Ser. No. 08/196,935 filed Feb. 15, 1994, now abandoned.

FIELD OF THE INVENTION

The invention is in the field of the processing of materials where energy is applied to a web type quantity configuration of the materials and in particular to a system of the applying of microwave energy for producing controlled even temperature in relatively thin web type quantity configurations of materials.

BACKGROUND AND RELATION TO THE PRIOR ART

As the specifications on materials and the steps in the processing of them become more stringent; and with the expanding of the applications where the materials are to be used, ever greater constraints are being encountered. The major continuous processing technique used in the art is the performing of an operation at a station on a quantity of a material. The material itself may be the web; as for examples a film or a layer of dielectric supporting material on which in the future there is to be the mounting of electronic components, or the fabrication of structural members. The material may be a finely divided particulate supported by a web.

One of the operations performed in the processing at a station is the application of heat in order to alter one or several properties of the material being processed. In the recent timeframe in the application of heat, the specifications that have to be met, have become more complex involving more than one type of alteration of the material. A particular example is the formation of some types of dielectric sheet materials into intermediate manufacturing products. In these types of operations, a coarse reinforcing material is coated or impregnated with a resin that in turn is suspended in a solvent or a liquid vehicle. With this type of material to be processed, the heating operation at a processing station includes the physical alteration of properties in drying and a precise portion of a chemical reaction in partial curing. The physical alteration of drying takes place by evaporation and by diffusion through the material both at independent rates. In the chemical alteration there should be a limit to the chemical reaction so that it only goes so far and is stopped even if the reaction is exothermic. The intermediate manufacturing product is known in the art as "prepreg" or "B stage" material. It is a stable material that is typically in the form of a sheet with the solvent removed. The chemical reaction of curing is only partially complete such that at elevated temperatures consolidation and fusing is possible. Further deformation, such as will occur in lamination or consolidation then takes place at a final assembly and full curing operation.

Accompanying the considerations in achieving the meeting of specifications, environmental concerns are becoming of increasing importance. Attention is being given to energy consumption and to the collection of volatile products driven off at processing stations. In the above example of "B stage" material, in the art, large vertical structures are used at substantial cost in providing an energy retaining and atmospherically enclosed environment for the process steps.

Efforts have been underway in the art to gain the benefits of energy efficiency and depth of penetration of microwave energy in web type processing systems.

In U.S. Pat. No. 4,234,775 the drying of a web of material is accomplished using a serpentine wave guide that goes back and forth across the web while hot spots are controlled by preventing the formation of a standing wave in the wave guide.

In U.S. Pat. No. 4,402,778 a laminating process line is described wherein laminations are pressed together into a web and in the process line the laminations are partially cured in a field between a pair of flat plates with final curing taking place in a subsequent station. This type of approach requires that the energy be in the radio frequency (RF) range and that heavily absorbing materials already in the "B stage" be used.

In PCT International Publication WO91/03140 of PCT Application PCT/AU90/00353, the drying of surface coatings is performed through the use of a microwave applicator that has independent sections above and below a web with each section having an antenna that extends length of the section.

A need is present in the art for greater precision in temperature and environmental control in the application of microwave technology to material processing.

SUMMARY OF THE INVENTION

A microwave processing system is provided wherein the material to be processed is in the form of a web type quantity configuration with a thickness that is small in relation to the wavelength of a particular microwave frequency in a microwave applicator. An additional aspect of the invention is the application of microwave energy for controlled processing of pre impregnated materials in a continuous manner.

The material is passed through the field associated with a plurality of microwave standing waves of the particular frequency, each adjacent standing wave being offset ¼ wavelength and all standing waves being along the direction of movement of the web. A carrier gas removes volatile solvents from the material surfaces. Control is provided for the interrelationship of temperature, rate of movement, flow of carrier gas, and microwave power. The microwave applicator construction employs as different types; multiple tuned cavities along the web movement with each adjacent cavity being offset ¼ wavelength from it's neighbor, or multiple interdigitated rods along the web movement with each adjacent rod being offset ¼ wavelength from it's neighbor.

BRIEF DESCRIPTION OF THE DRAWINGS

FIG. 1 is a schematic perspective illustration of a web of material passing through offset microwave standing waves.

FIG. 2 is a graphical depiction of the leveling of the heating achieved through the offsetting of the microwave standing waves.

FIG. 3 is a graphical depiction of the temperature distribution through a web thickness of material during conventional processing.

FIG. 4 is a graphical depiction of the temperature distribution through a web thickness of material during the microwave processing of the invention.

FIG. 5 is a graphical depiction of the temperature and time relationship in curing an example material.

FIG. 6 is a graphical depiction of a heating profile of a material divided into processing stages.

FIG. 7 is a cross sectional illustration of a fast wave single or multimode standing wave applicator of the invention.

FIG. 8 is a cross sectional illustration of a rod resonant cavity type standing wave applicator of the invention.

FIG. 9 is a plan view along the line 9—9 of FIG. 8 of the rods in the rod standing wave applicator.

FIG. 10 is a schematic perspective view of an evanescent standing wave applicator of the invention.

FIG. 11 is a schematic cross section of the material being processed in the microwave energy field of the applicator in FIG. 10.

FIG. 12 is a perspective view of a slow wave or helical applicator of the invention.

FIG. 13 is a schematic cross section illustrating the field in the applicator of FIG. 12 in relation to the material being processed.

DESCRIPTION OF THE INVENTION

Figure 14:
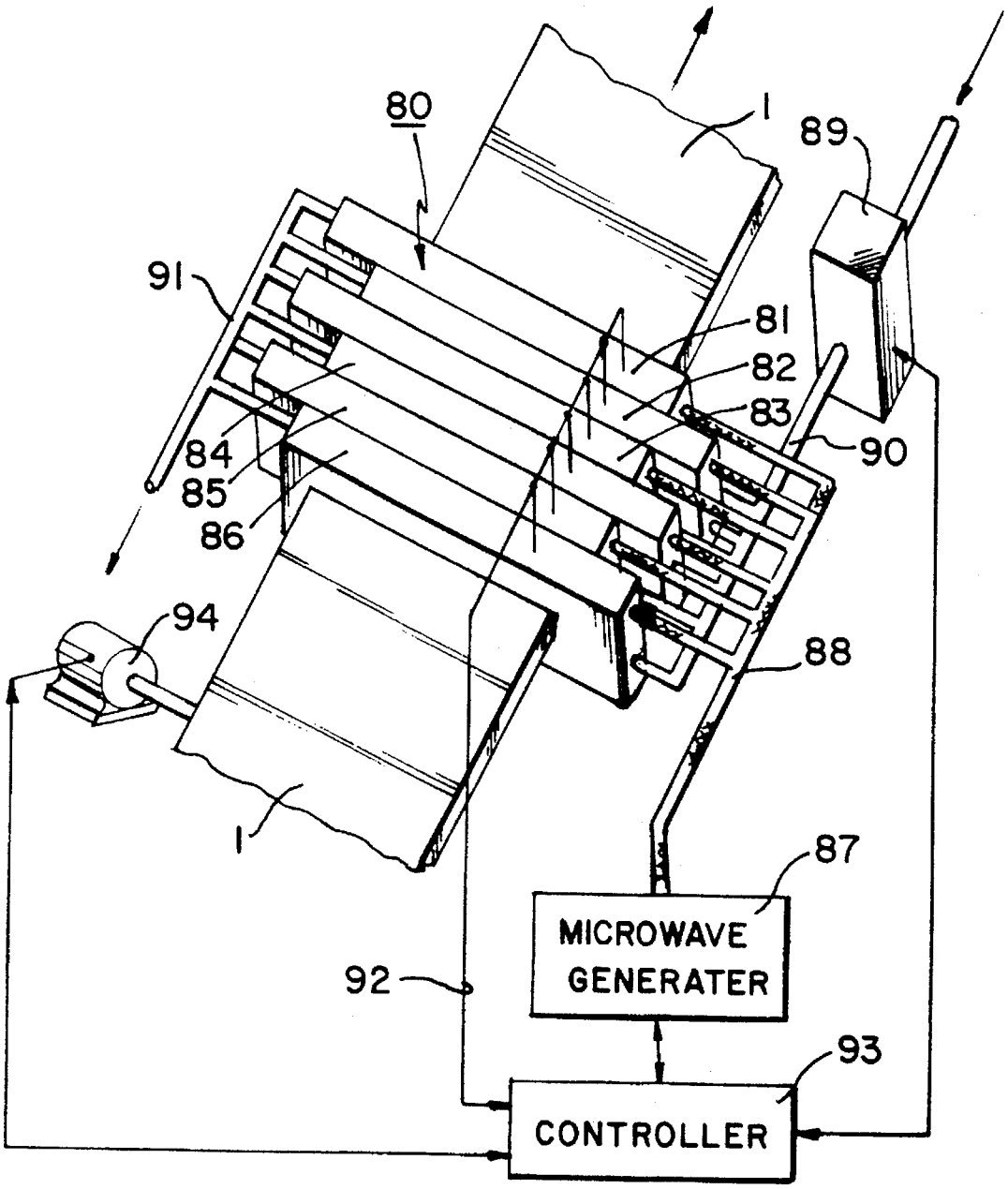
FIG. 14 is a perspective illustration of the microwave system for heating materials of the invention illustrating the processing region and the controls.

In accordance with the invention the material to be heated is in the form of a web in a thickness that is small in relation to the peak to valley distance of the microwave frequency being used. As an example range, the thickness is usually about 50 micrometers to about 5 millimeters. Where the material is in liquid or particulate form, gravity or a microwave transparent support such as a 5 micrometer thick teflon film may be used. For clarity of explanation the term web is used for the quantity configuration of the material being processed. The material passes through a plurality of microwave standing waves in an enclosure where the temperature can be monitored and a carrier gas can remove volatile ingredients driven off in the heating. Adjacent standing waves are offset ¼ wavelength from each other to even out the applied energy.

Referring to FIG. 1 a perspective illustration is provided in which a web 1, of the material or carrying the material to be heated, passes through a processing stage 2. In the stage 2 the web 1 passes through one or a plurality of microwave standing waves of which two, elements 3 and 4 are shown dotted, in position, transverse to the movement of the web 1. The thickness of the web 1 is small in relation to the peak 5 to valley 6 distance of the standing waves 3 and 4, which pass completely through the web of material 1. Each adjacent subsequent standing wave along the path of movement of the web 1, in the illustration of FIG. 1 that would be element 4 following element 3, is offset ¼ wavelength which operates to even out the electromagnetic energy to prevent hot spots and assists in preventing adjacent standing waves from coupling into each other. The leveling effect is graphically depicted in FIG. 2. It will be apparent that additional ¼ wave offset waves could be provided within the illustrated waves of FIG. 2 to further even out the microwave energy. While two standing waves 3 and 4 are shown, as many as needed may be positioned serially along the direction of movement of web 1. A microwave source 7 provides microwave power to each of standing waves 3 and 4 through wave guides or coaxial cables 8 and 9, which include impedance matching devices or tuners to obtain maximum energy input to elements 3 and 4. The temperature at the surface of the web of material 1 in each stage is monitored by optical pyrometry or probes. Temperature measuring elements 10 and 11 are shown for elements 3 and 4 respectively.

The standing waves 3 and 4 are each shown as being in a separate environmental control housing shown as elements 18 and 13 respectively in dotted outline. The web 1 passes through aligned apertures in the housings, of which aperture 14 is visible in this illustration. A carrier gas enters at arrows 15 and 16 and exits at arrows 17 and 18 for elements 3 and 4 respectively. The carrier gas carries away from the surface of the web of material 1, all volatile products of the heating of the web of material 1, such as solvents, water vapor and chemical reaction products, and transports them for appropriate disposal or recycling, not shown. It will be apparent that a single housing for all standing waves, with a single carrier gas ingress and egress, could be designed and implemented.

In operation, the power of the microwave source 7, the rate of travel of the web 1 as indicated by arrow 19 and the rate of ingress of the carrier gas at arrows 15 and 16, are monitored and adjusted through a controller, not shown in this figure, that is responsive to time and temperature. While the apparatus provides a continuous process, through initial calibration, such items as temperature distribution through the thickness of the web, rate of travel of the web and carrier gas flow, are set.

In accordance with the invention while the principle could employ all frequencies in the microwave range from about 300 megahertz(MHz) through about 100 gigahertz(GHz) with a selection influenced largely by the physical size of the wavelength, there are practical considerations that influence frequency selection. There are two frequencies, 915 MHz and 2.45 GHz that do not interfere with communications and have been incorporated into mass produced items such as appliances. This has resulted in low cost, high quality and reliability of the components used at those frequencies and makes either of those frequencies a good economic choice. In the case of the 2.45 GHz frequency the wavelength would be about 12 cm or about 6 inches so that a transverse standing wave for a web from 15 cm to 63 inches wide would be in the range of 3 to 11 wavelengths.

The precision in processing of the invention is illustrated in connection with FIGS. 3–6 wherein; in FIGS. 3 and 4 the temperature distribution through the thickness of thee material of the web 1 is depicted for conventional processing in FIG. 3 and for the microwave processing of the invention in FIG. 4. In FIG. 5 the curing rate of an example resin filled dielectric material is depicted, and in FIG. 6 an overall time temperature profile of a material is depicted. Referring to FIG. 3 in conventional processing the applied heat enters through the surfaces which produces a situation where the temperature at the center, labelled A, is lower than at the surfaces, labelled B. Referring to FIG. 4, in accordance with the invention the standing wave goes completely through the material producing a higher temperature at the center labelled A than at the surfaces labelled B. The temperature at A being produced independent of the surfaces by the penetrating microwaves of the standing wave. In accordance with the invention, control is available to handle materials where there are solvents or emulsions containing organic compounds or water to be driven off and chemical reactions such as epoxidation which progress together in a heating stage but which may involve different physical and chemical processes that take place at different rates. With the invention the thickness, the rate of travel and the temperature at A are set for driving off solvents at a set rate and sustaining a chemical reaction at a set rate and with the temperature B being monitored for temperature overshoot, as would occur with an exothermic chemical reaction, each being controllable and correctable. The carrier gas sweeping over the surfaces reduces buildup of the driven off products thereby enhancing the rate of the physical processes through those surfaces.

Referring next to FIG. 5 there is a graphical depiction of a time and temperature curing rate of a typical thermosetting plastic material of the type used in such applications as printed circuit boards and dielectric sheets for mounting electronic components. In this type of material there is a supporting loose fiber layer that is impregnated with a thermosetting plastic resin suspended in a solvent or vehicle. In the heating station it is desired to drive off the solvent, partially react the thermosetting resin to about 25% of full curing and render the surfaces such that dirt will not adhere, producing thereby an intermediate manufacturing product, known in the art as "prepreg" or "B stage" material that can be placed on the shelf for later specific application operations. The point labelled C represents the gel point for the resin or the situation where the thermosetting reaction has progressed so far that there is insufficient deformation ability remaining. For perspective, the 25% cure is the narrow range labelled D. The control provided by the invention as described in connection with FIG. 3 permits heating to produce product that is within in the range D.

Referring to FIG. 6, a graphical depiction is provided of a time-temperature heating operation to produce an example product. In accordance with the invention the operation is divided into separate heating stages E–I with each stage heating being in a microwave field with the stages positioned transverse and serially along the travel of the web of material which may result in a fairly long processing region in the direction of travel of the web 1. Between each stage, there can be temperature,, cure and thickness monitors communicating with a central controller, so that the microwave power at each stage can be independently controlled in real time to give the desired product.

The term applicator has evolved in the art for the structure that couples the microwave field into the material being processed. There are four general types of applicators at this stage of the art. They are referred to in the art as Fast Wave applicators, Slow Wave applicators, Traveling Wave applicators and Evenescent applicators. In practice they may be used in combinations. The applicators differ principally by the method that the electric field they produce couples into the material being processed. A selection is usually a tradeoff. The Fast Wave applicators involve single and multi resonant modes that have the characteristics that the electric field is high butt uneven due to the nodes in the standing wave. In the Travelling Wave applicators in general the wave energy passes the material only once and the electric field intensity is lower but more uniform. The Evanescent applicators provide an intense electric field and require greater prevention for external coupling. The principle of the invention can be built into and used with most applicator structures.

In FIGS. 7–13 there are illustrations of the applicator structural considerations in applying the principle of the invention. In FIG. 7, the Fast Wave, or single and multimode type of applicator, is illustrated, and in FIGS. 8 and 9, a rod resonant cavity type of applicator is illustrated.

Referring to FIG. 7 a side view is shown of the single or multi mode type applicator in which a standing wave 30 made up of a wave 31 and superimposed reflected wave 32 all shown dotted are set up in a housing 33 having the dimensions of a tuned microwave cavity for a microwave frequency introduced through coupler 34. The superimposed wave 38 is reflected from shorting end plates 35 and 36 with coupler 34 being insulated, not shown, from plate 36. An opening 37 and an opposite one 38, not visible in this figure, are provided to accomodate the ingress and egress of the web of material to be passed through the standing microwave field. Ports 39 and 40 are provided for the passage of a carrier gas for carrying away volatile effluent appearing at the surfaces of the web of material. A temperature sensor 41 of the optical pyrometer or probe type is provided to monitor the surface temperature of the web of material; with a duplicate, not shown, for the under surface in the event the application were to require monitoring of the temperature of both surfaces. In the single and multi mode resonance, as may be seen from the waves 31 and 32, there are nodes that could produce uneven heating. In an application where the unevenness is of significance a second cavity sized housing 42 is positioned with a side in contact with a side of the housing 33 and offset ¼ wavelength so that there is a ¼ th wavelength distance between the end plate 36 of housing 33 and the end plate 43 of housing 42, and with the openings for the web of material aligned. The ¼ wavelength offset evens out the uneven heating and reduces coupling from one housing to another through the slots for the web of material. Corresponding carrier gas ports 44 and 45, temperature sensor 46 and microwave input coupler 47 to those of housing 33 are also provided in housing 42.

In use, a separate applicator of the single or multi mode type would be employed for each processing stage E–I of FIG. 6.

Referring next to FIG. 8 there is illustrated a schematic side view of the structural properties involved in a rod resonant cavity type applicator. In FIG. 8, in a housing 50, positioned transverse to the path of the web, with a web accommodating opening 51; microwave antenna rod combinations 52 and 53, are positioned above and below the web of material, not shown that passes through the opening 51; and a grounded metal member 54 provides coaxial properties and intensifies the electric field of the waves 55, shown dotted, that are produced by applying a microwave frequency source, not shown, to the rods 58 and 53 through the common portion 56. The waves 55 are in the TEM mode. Carrier gas ingress and egress ports 57 and 58 respectively and a capability for monitoring the temperature of the surface or surfaces of the web of material shown as element 59, are provided. A rod combination consisting of common portion 60 with an above rod 61 and below rod 62 for the next stage along the path of movement of the web is positioned with the common portion 60 on the opposite side of the web from element 56.

Referring to FIG. 9, which is a top view along the lines 9—9 of the rods of FIG. 8, the rods 52 above and 53 below and 61 above and 62 below are interdigitated from stage to stage along the path of movement of the web shown dotted. The rods must be a conductive element with low resistivity such as plated or solid copper which in turn may be coated with a conductive or dielectric material to prevent corrosion. As many above and below rod pairs are provided as there are desired serial processing stages in the path of the web of material. The individual parallel rods are each separated by a distance, of ¼ wavelength of the microwave frequency being used, in the direction of the path of the web of material outlined by the dotted lines, and, the groups are also positioned as close as practical on each side of the path of the web of material; to maximize fringing and coupling effects between them. Fringing and coupling between rods on the same side of the web can also be controlled by grounded shielding in various shapes around the rods and by the use of dampening material between rods. Elimination of the member 54 reduces the electric field intensity. The rods may be placed closer together in the direction along the path of the web, shown dotted, by embedding them in a dielectric material that reduces wavelength.

In use, a single rod combination and the electric field associated with it, serves as a separate applicator stage for each of heating stages E–I of FIG. 6. A single housing 50 covers all applicator stages. A single, carrier gas, port combination, 63 and 64, should be sufficient, unless there are unique flow problems, in which case they can be duplicated and manifolded as needed. The separate temperature monitoring capability 59 is duplicated and provided for each surface to be monitored.

Referring next to FIG. 10 there is shown a schematic perspective view of the structural considerations in the application of the principles of the invention in an applicator with evanescent properties. In FIG. 10, in a waveguide 65 in which microwave power is supplied through cable 66, there is set up a standing wave the field of which is depicted by the arrow 67. The waveguide 65, in the surface 68 above the standing wave, is provided with a series of slots 69 in the waveguide wall through which microwave energy is permitted to escape and extend through the material being processed in the web 1 which moves, in the direction of the arrow, and is positioned close to but does not touch the surface 68. The web 1 passes through an environmental control housing, not numbered, of the type shown as element 33 in FIG. 7 which is equipped with carrier gas ingress and egress ports such as elements 39 and 40 and temperature monitoring means such as element 41 all shown in FIG. 7.

In FIG. 11 there is shown a schematic cross section depicting the microwave energy emanating from the slots 69 of FIG. 10 passing through the material being processed. Referring to FIG. 11, an locallized field of microwave energy 70 emanates in a short but intense shape. The material being processed 1 is passed close to the surface 68 and through the field 70 of as many slots 69 as are provided.

Referring next to FIG. 12 there is shown a schematic perspective view of the structural considerations in the application of the principles of the invention in a slow wave or helical type applicator. In FIG. 12, in a processing region 71 a helically wound series of microwave conductors 72 that are supplied with microwave power at 73 pass above and below the web 1 of material being processed which moves in the direction of the arrow. The microwave energy field progresses along the helical configuration in a slow wave passing through the web 1. The web 1 passes through an environmental control housing, not numbered, of the type shown as element 33 in FIG. 7 which is equipped with carrier gas ingress and egress ports such as elements 39 and 40 and temperature monitoring means such as element 41 all shown in FIG. 7.

In FIG. 13 there is shown a schematic cross section depiction of the elements of FIG. 12 wherein in the region 71 several turns of the helix 72, supplied with power at 73 pass around the web 1 that is moving in the direction of the arrow. The electric field associated with the slow wave is less intense but is generally more uniform.

Methods for controlling the electric field strength in the region of the material include varying the microwave power and varying the tuning of the applicator. The varying the tuning of the applicator may for example be accomplished by variation of the length of the cavity or by varying the frequency.

In order to provide a starting place for one skilled in the art to practice the invention the principles of the invention are applied in the system illustrated in FIG. 14. In FIG. 14 a web of material 1 is passed through a processing region 80 made up of six transverse individual processing stages 81–86 each of the single or multimode standing wave type as discussed in connection with FIG. 7. A source of microwave power 87 is provided by a microwave generator such as a Micro-Now™ Model 420B1 for introducing microwave energy at a frequency of 2.45 GHz supplying of the order of 500 watts through coaxial cabling 88 to each stage 81–86. The housings for the stages 81–86 are made of standard WR284 waveguides, every other one offset ¼ wavelength and with aligned length slots for the web of material 1 through the region 80. The region 80 is usually about 0.2 to 1 meter in length. The height above and below the web of material 1 is about 5 centimeters each. The web of material 1 is about 50 micro meters to about 5 millimeters thick and from about 15 centimeters to about 63 inches wide.

A carrier gas such as nitrogen, air or dried air as examples, which may be heated, is supplied through a control valve 89 and manifold 90 into each of the stages 81–86, and exhausted to a recovery manifold 91. The temperature monitors for each stage are cabled into conductor 92 and serve as control inputs to a controller 93 which may be a programmed personal computer. The rate of travel of the web 1 is controlled by a variable speed motor 94. All controls except temperature are two way so that the controller not only introduces changes but also maintains settings and monitors performance.

In operation most adjustments for the particular processing to be done are accomplished in a calibration and then, on line, the temperature data permits rate of travel, temperature through power and carrier gas flow, control as desired.

What has been described is the passing of a material being processed in a continuous quantity shape through a microwave field where the thickness of the shape is related to the frequency of the microwaves producing the field by being less than the wavelength.

What is claimed is:

1. In apparatus for coupling microwave energy into a material, the improvement comprising:

a heating stage, said heating stage including a web type quantity configuration of a material to be processed, means for passing said web along a path of movement in a first direction through said heating stage, at least two of a plurality of the same frequency, single mode, microwave standing waves, each said standing wave being positioned in a direction transverse to said first direction, and, each adjacent said standing wave, serially along said first direction, being positioned with a ¼ wave offset, said web type quantity configuration of material being processed in said heating stage, said means for passing said web type quantity configuration of material and said microwave standing waves in said heating stage being related, in that said material has a thickness dimension in said heating stage that is less than said standing wave peak to valley distance.

2. The apparatus of claim 1 including means for monitoring the temperature at at least one location of at least one surface of said web type quantity of material in each said stage.

3. The apparatus of claim 2 including means for providing a flow of a carrier gas over at least one surface of said web type quantity of material in each said stage.

4. The apparatus of claim 3 including means for altering at least one of, the rate of movement of said web type quantity of material along said path of movement through said heating region, the power in at least one said electric field of microwave energy, and, the rate of flow of said carrier gas.

5. A microwave applicator stage for applying microwave energy to material to be processed, said stage comprising in combination:

a web type quantity configuration of a material to be processed, delivery means, for providing a path of movement of said web type quantity configuration of said material to be processed, in a first direction through said stage, and, heat application means of at least two of a plurality of the same frequency, single mode, microwave standing waves, each said standing wave being positioned in a direction transverse to said first direction, and, each adjacent said standing wave, serially along said first direction, being positioned with a ¼ wave offset, said web type quantity configuration of material, the path of said delivery means and said microwave standing waves being related, in that said material has a thickness dimension in said applicator stage that is less than said standing wave peak to valley distance.

6. The applicator of claim 5 including means for monitoring the temperature at at least ore location of at least one surface of said web type quantity configuration of material.

7. The applicator of claim 6 including means for providing a flow of a carrier gas over at least one surface of said web type quantity configuration of material.

8. The applicator of claim 7 wherein said means for providing a standing wave associated with a particular microwave frequency is a separate cavity tuned for said particular microwave frequency.

9. The applicator of claim 7 wherein said means for providing a standing wave associated with a particular microwave frequency is a microwave antenna of a two rod combination of conductive rods the first rod thereof positioned adjacent to one surface of said web type quantity configuration of material and the second rod thereof positioned adjacent the remaining surface of said web type quantity configuration of material.

10. The applicator of claim 9 including a grounded conductive member positioned separated from but parallel to said second rod.

11. The applicator of claim 9 wherein subsequent microwave application stages along said path of movement includes multiple said rod antenna combinations that are positioned alternately from side to side of said path of movement and are separated along said path of movement by a distance of at least ¼ wavelength of said particular frequency.

12. The applicator of claim 11 including a grounded conductive member positioned separated from but parallel to each said second rod.

13. The applicator of claim 7 wherein said means for providing a standing wave associated with a particular microwave frequency is a waveguide having microwave leakage permitting slots in a surface of said waveguide and said delivery means positions said path of movement through said microwave leakage.

14. The applicator of claim 7 wherein said means for providing a standing wave associated with a particular microwave frequency is a helical pattern of microwave conductors surrounding a location in said path of movement of said web type quantity of material being processed.

15. The process of applying microwave energy to a material comprising the steps of:

providing said material in a moving web type quantity configuration, passing said web through an applicator in a first direction, providing in said applicator at least two of a plurality of the same frequency, single mode, parallel microwave standing waves, transverse to said first direction, with each adjacent said standing wave, serially along said first direction, having a ¼ wave offset, and wherein said web thickness is less than the peak to valley distance of said standing waves where said web passes through said waves.

16. The process of claim 15 wherein said step of passing said material includes the steps of providing an additional microwave standing wave along the direction of movement of said moving web for each additional application of microwave energy to said material.

17. The process of claim 15 including the step of monitoring the temperature at at least one location of at least one surface of said material.

18. The process of claim 17 including the step of passing a carrier gas over said material.

19. The process of claim 18 including the step of altering the rate of at least one of movement of said material, microwave power, and movement of said carrier gas.

* * * * *